United States Patent [19]

Streib

[11] Patent Number: 4,480,960

[45] Date of Patent: Nov. 6, 1984

[54] ULTRASENSITIVE APPARATUS AND METHOD FOR DETECTING CHANGE IN FLUID FLOW CONDITIONS IN A FLOWLINE OF A PRODUCING OIL WELL, OR THE LIKE

[75] Inventor: Stephen F. Streib, Novato, Calif.

[73] Assignee: Chevron Research Company, San Francisco, Calif.

[21] Appl. No.: 184,558

[22] Filed: Sep. 5, 1980

[51] Int. Cl.[3] ..... F04B 49/02; F04B 49/06; F04B 49/00

[52] U.S. Cl. ..... 417/12; 417/43; 417/53

[58] Field of Search ..... 417/12, 43, 53; 340/607; 73/190 H

[56] References Cited

U.S. PATENT DOCUMENTS

| | | | |
|---|---|---|---|
| 2,729,976 | 1/1956 | Laub | 73/204 |
| 3,073,244 | 1/1963 | Elliot et al. | 417/43 |
| 3,091,179 | 5/1963 | Echols | 417/12 |
| 3,269,320 | 8/1966 | Tilley et al. | 417/53 |
| 3,724,267 | 4/1973 | Zoschak | 73/190 H |
| 3,821,726 | 6/1974 | Chang et al. | 340/606 |
| 4,197,738 | 4/1980 | Degenue | 73/190 H |

*Primary Examiner*—William L. Freeh

*Attorney, Agent, or Firm*—Harold D. Messner; Edward J. Keeling

[57] ABSTRACT

Transient change in heat flux due to ultrasmall variation in flow conditions, say from flow-to-no flow within a flowline of a wellhead connected to an oil well penetrating an earth formation, is surprisingly useful in pinpointing the occurrence of adverse "pump pounding" during the production cycle of the well. In one respect, the change in flux is monitored within each flowline using a heat flux transducer/meter in series with a pump controller. Cascading the signal output, i.e. serially combining the outputs of N thermocouples the transducer/meter, enhances sensitivity. In a preferred case, N is about 80 but can be as high as 320, if desired.

7 Claims, 5 Drawing Figures

ULTRASENSITIVE APPARATUS AND METHOD FOR DETECTING CHANGE IN FLUID FLOW CONDITIONS IN A FLOWLINE OF A PRODUCING OIL WELL, OR THE LIKE

SCOPE OF THE INVENTION

This invention relates to an ultrasensitive but inexpensive apparatus and method for sensing smmall changes in heat flux due to a corresponding low flow of fluid within a body under varying conditions, especially a transient condition in which such fluid flows unexpectedly occur. The invention has particular application in indicating the unexpected stoppage of oil flow within a flowline or series of such lines in an oil-producing complex.

RELATED APPLICATIONS

My following applications, filed simultaneously herewith, are incorporated by reference:

(i) "Ultrasensitive Apparatus and Method for Detecting Change in Fluid Flow, Especially During the Occurrence of a Transient Condition" Ser. No. 184,559 filed Sept. 5, 1980, now U.S. Pat. No. 4,433,329; and (ii) "Ultrasensitive Method and Apparatus for Detecting Change in Fluid Flow Conditions in Relief Flowlines Associated with a Chemical or Refinery Complex" Ser. No. 184,560 filed Sept. 5, 1980, now U.S. Pat. No. 4,434,418.

BACKGROUND OF THE INVENTION

The art of detection of fluid flow is replete with different classifications of inventions indexed for different purposes, say based on type of use involved versus their principles of operation. While detection of change in flow of fluids (under flow/no-flow conditions) using transient heat transfer principles may have occurred, I am unaware of any detector or method which has cascaded the output effect to detect an ultrasmall change in flow conditions under a variety of occurrences, especially say from a heat sensing position completely exterior of the fluid-carrying body while maintaining the integrity of the interior of the body intact, i.e. without providing openings through the body itself.

SUMMARY OF THE INVENTION

In accordance with the present invention, transient heat flux due to small variation in flow conditions (from flow-to-no-flow) within a flowline of a wellhead connected to an oil well penetrating an earth formation, is surprisingly useful in pinpointing "pump pounding" during the producing cycle of the well. Result: the pump can be deactivated when "pump pounding" is severe. (Pump pounding occurs when liquid and gas phase exist together in the pump barrel. Then as the pump piston moves down the barrel through the gas phase, it eventually strikes the surface of the liquid causing "pounding" of the pump and its associated support apparatus.)

In an apparatus aspect, the change in heat flux due to change in oil flow within the flowline attached to the wellhead, is monitored using a heat flux transducer/meter physically attached to the flowline but electrically connected to the pump controller. Changes in output signal level of the transducer/meter is used to initiate pre-set control functions of the pump controller vis-a-vis pump power supply. Cascading the signal output of the meter, i.e. serially combining the outputs of N thermocouples in thermopile fashion, also allows the controller to only operate when a threshold level is deviated from by a pre-selected value. In the method aspect, performance of the transducer/meter is further enhanced by its attachment to the flowline via a heat conducting adhesive. Result: minimization of background signal level is achieved. Cascading the signal output of the transducer/meter also can provide the controller with improved sensitivity. I.e., the controller can quickly shut down the pump when deviations from its pre-set threshold level—within a selected amount—occurs. Simultaneous with shut down, a timer within the controller can be activated. Result: after the pump has been deactivated for a certain time period and the time reset, the pump can be automatically restarted.

DESCRIPTION OF AN EMBODIMENT OF THE INVENTION

Figure 1:
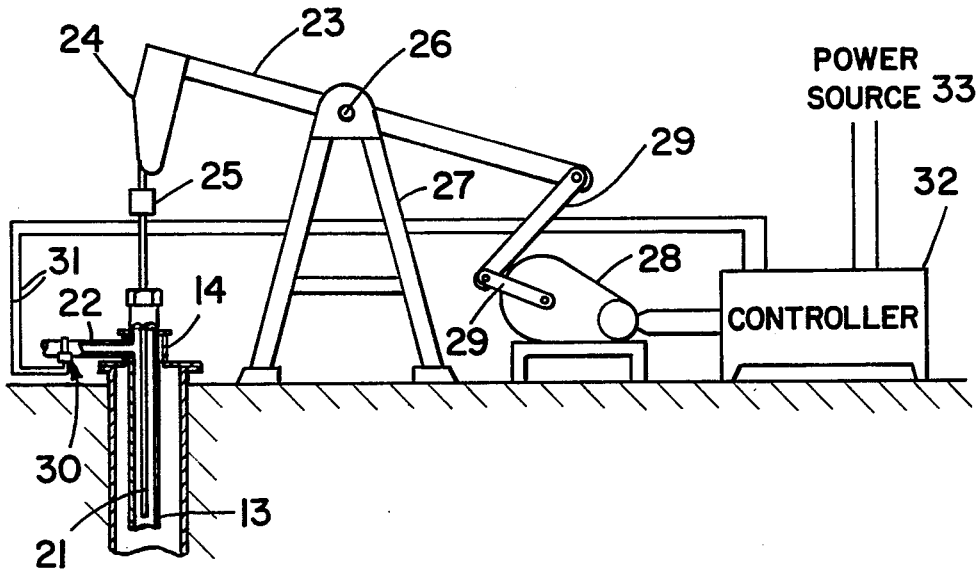
FIG. 1 is a side elevational view, partially cut-away, of a well penetrating an earth formation in which a pump for raising oil to a flowline attached to a wellhead, is controlled via a control system that includes a heat flux transducer/meter physically attached to the flowline but electrically attached to a pump controller intermediate as electrical source of pump power.
Figure 1:
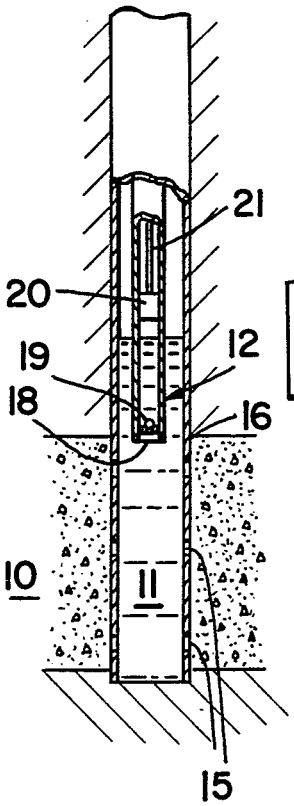

With reference now to FIG. 1, a form of pumping apparatus is diagrammatically illustrated. As there shown, oil is being recovered from formation 10 through well 11 by means of pump 12 generally indicated at 12, and tubing 13. The oil enters the well 11 through slots 15 in casing 16. The pump 12, located adjacent to producing formation 10, is used to raise oil to the surface. Its operation is well known: generally, the oil enters the pump chamber through port 18 below standing valve 19. A traveling valve 20 connected by appropriate means to sucker rod 21 utilizes reciprocating motion to move oil up the tubing 13 to the wellhead 14 and out flowline 22.

The sucker rod 21 is reciprocated by means of a rocking arm 23. A horse's head 24 is provided at one end of the rocking arm 23 and is connected to the sucker rod 21 by a bridle 25. The rocker arm 23 is pivotally connected by suitable means, such as pin 26, to a Sampson post 27. The other end of the rocking arm 23 is driven by electric motor 28 through appropriate linkage 29.

Note that when liquid level in the barrel of the pump 12 is above the upper level of the traveling valve 20 no pounding occurs. However, when the liquid level in the pump barrel is below the upper end of the traveling valve's motion (as illustrated), then pounding occurs when the traveling valve 20 contacts the liquid on the downstroke of the pump 12. When the standing valve 19 strikes the liquid on the downstroke, the shock resulting from the impact is transmitted up the sucker rod 21 and through the pumping apparatus.

In accordance with the present invention, such "pump pounding" is sensed, not via vibrations, but by change in flow conditions within flowline 22 via a highly sensitive heat flux transducer-meter generally indicated at 30 in FIG. 1.

Purpose of the meter 30: to sense transient heat flux within the flowline 12 and transmit signals representing such variations via conductors 31 to controller 32 for disconnectably connecting, in controlled fashion as explained below, motor 28 relative to power source 33. The term "transient" is defined at pages 275–277 "PRINCIPLES OF ENGINEERING HEAT TRANSFER", Warren H. Giedt, Van Nostrand Company, Inc., Princeton, N.J., 1965.

Figure 2:
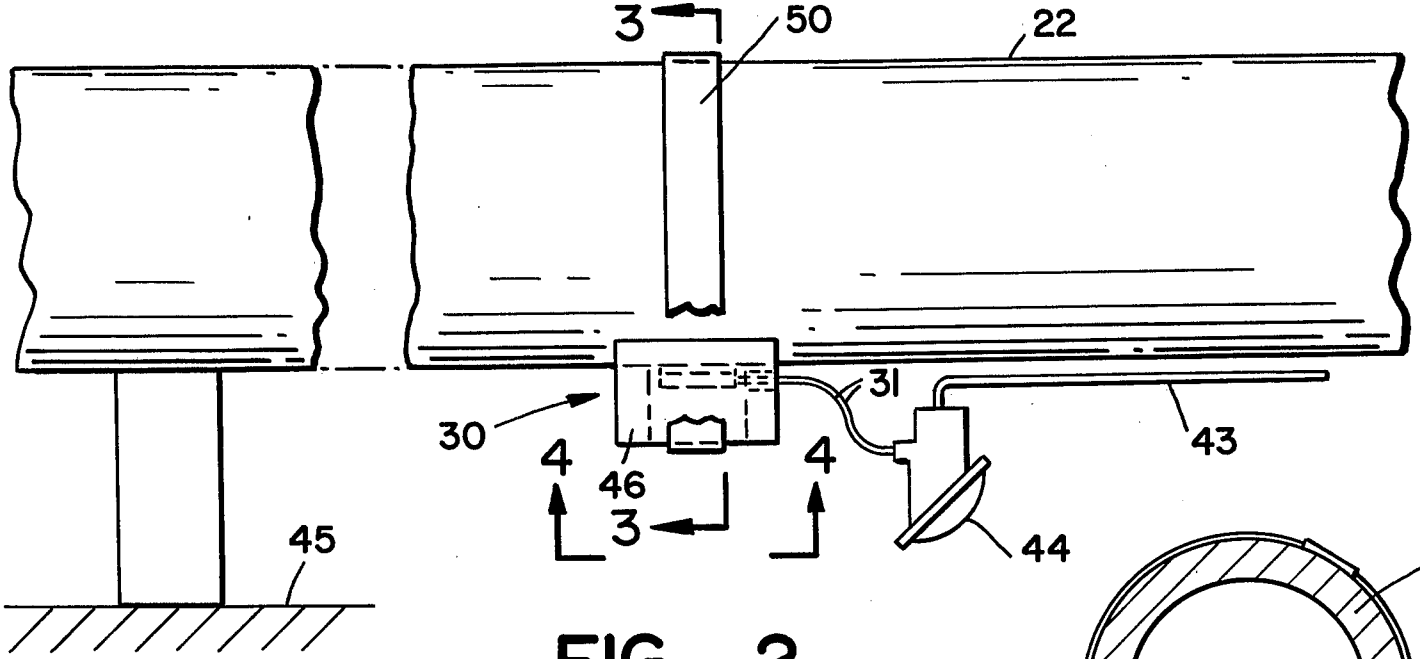
FIG. 2 is an enlarged side view of the flowline of FIG. 1 illustrating attachment and operation of the transducer/meter of the present invention.

FIG. 2 illustrates transducer/meter 30 in more detail.

Figure 3:
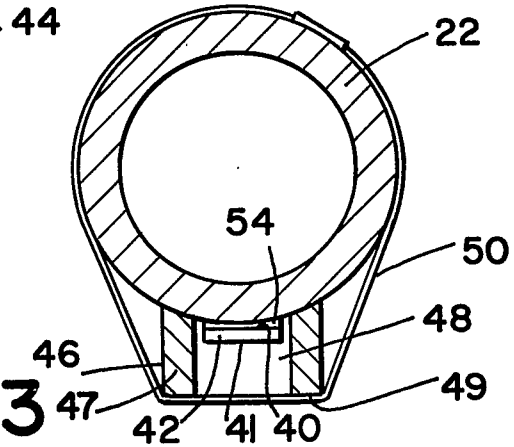
FIG. 3 is a sectional view of the transducer/meter of FIG. 2 taken along line 3—3.

Operation of the flux transducer/meter 30 in the present invention in a somewhat conventional application of thermopile principles in which temperature differences (delta-T) between oplates 40 and 41, see FIG. 3, connecting to a plurality of N thermocouples etched on insulating board 42 combination generate a potential signal proportionate to delta-T. That is to say, both plates 40 and 41 and the plurality of N thermocouples form elements of the aforementioned thermopile circuit by which the outputs are cascaded. Result: a surprisingly sensitive millivolt output is produced proportional to the heat flux passing through the transducer/meter 30 as a direct function of change in fluid flow within the flowline 22 (either in gas or liquid phase, or both). (In this regard N is preferably about 80 but can be equal to 320 if desired.)

Calibration of the transducer/meter 30 is required, and usually each meter 30 is provided with a separate calibration curve and temperature correction curve. In this regard a particular adaptable transducer/meter 30, including useful calibration and correction curves, is manufactured by International Thermal Instrument Company, Del Mar, Calif., to the following specification:

Temperature range: −425° F. to 550° F.
Material: Polyimide-glasses
Max Flux Density: $10^6$ BTU/Hr $Ft^2$
Time Constant: 1 Second (Approx)
Output Resistance: 30 Ohms to 500 Ohms
Sizes: $\frac{1}{4}'' \times \frac{1}{2}''$ to $4'' \times 4''$
Accuracies: 10% to 1%
Sensitivities: 7 to 250 BTU/Hr/$Ft^2$/Mv Note that in the depicted operation of FIGS. 2–4, the associated pump controller is not pictured. However, the latter is electrically connected to the transducer/meter 30 via conductors 31, housed within conduit 43 via receptacle 44.

Also supported about the transducer/meter 30 above ground surface 45 is shielding bonnet 46 positioned on the underside of the line 22, relative to the direction of gravity.

Figure 4:
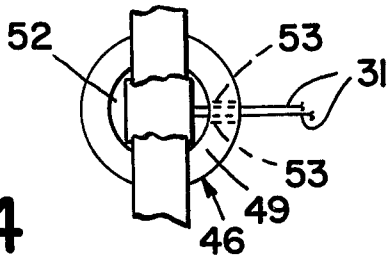
FIG. 4 is a detailed view of the transducer/meter of the present invention taken in the direction of line 4—4 of FIG. 2.

FIGS. 3 and 4 illustrate bonnet 46 in more detail.

As shown in FIG. 3, bonnet 46 is cylindrical and includes a sidewall 47 forming a cavity 48 open at endwall 49 beneath the underside of the flowline 22 but closed at its opposite and in contact with line 22. Strap 50, circumferentially stretching about the relief line 13 semipermanently supports the bonnet 46 relative to the line 22.

Since it is desirable to have a small thermal resistance at its contact surface with the line 22, boundary 51 of the bonnet 46 can be bonded to increase the rate of heat flow in the plane of the endwall.

To avoid further thermal interference with transducer/meter 30 of the present invention, the bonnet 46 is also centered about the former (but can be in direct metal-to-metal contact therewith) with a somewhat annular air space 52 therebetween, see FIG. 4. Sidewall 47 of the bonnet 46 is also provided with openings 53 through which the electrical conductors 31 extend, see FIG. 4.

The openings 42 can be sized to fit snugly about the conductors. In that way, rain, moisture, or other environmental factors can be somewhat inhibited from directly contacting each transducer/meter 30 during operations thereof. Hence, the latter's operations remain stable once calibration has occurred and its background signal level correspondingly remains at a minimum level.

In order to further minimize background noise level, the transducer/meter 30 of the present invention must be firmly attached to the line 22. In this regard a conventional heat conductor adhesive 54 (see FIG. 3) having a high conductivity value such as between 15–20 BTU's per hour per square foot per degrees F. per inch of thickness can be used. In this regard, an adhesive manufactured by Thermon Manufacturing Company, San Marcus, Tex., under the trade name "Thermon" has proven adequate in all applications. Such adhesive 54 aids in providing substantially noise-free signals via the conductors 31 (within conduit 43) for operating the controller 32 of FIG. 1.

Figure 5:
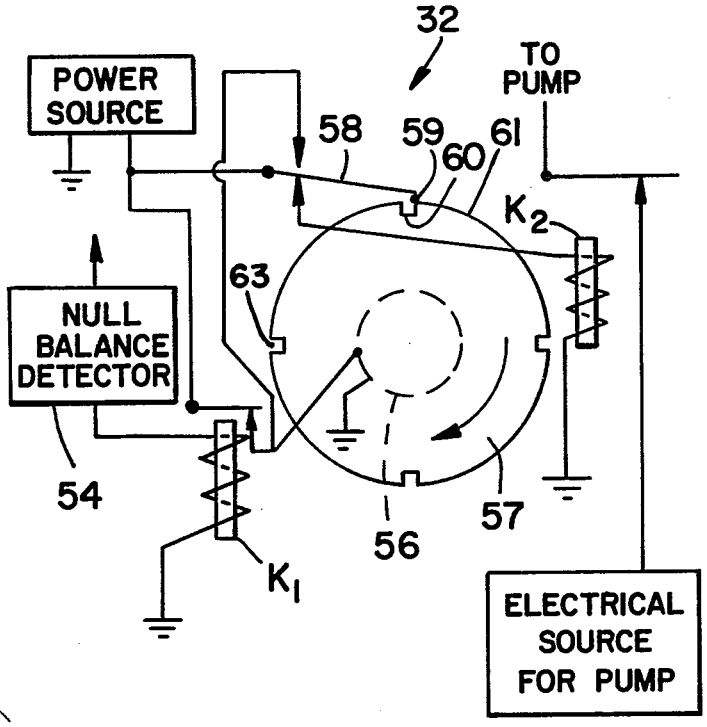
FIG. 5 is a circuit diagram of the pump controller of FIG. 1.

FIG. 5 illustrates operation of controller 32 in more detail.

In general, controller 32 senses a change in signal level via the transducer/meter 19 at a null-balance detector circuit 54 but the latter does not immediately disconnect the pump motor. Circuit 54 is conventional. It includes a calibrated voltage divider, a reference potential circuit, and a null detector, to indicate signal output from the transducer/meter 19. Thus, circuit 54 provides an output signal only if the signal level deviates from its reference a selected amount. If such is the case, relay $K_1$ is deactivated which in turn causes clock motor 56 to turn slotted wheel 57 at a constant rate, e.g., one revolution per day or 15° per hour.

Microswitch arm 58 has a finger 59. As long as finger 59 is positioned in slot 60, the pump is in circuit with source 53 via activation of relay $K_2$. However, when finger 59 moves out of the slot 60, and up the rim 61 of the wheel, the microswitch arm 58 is released, deactivating relay $K_2$ and disconnecting the pump from source 53.

Raising the microswitch arm on the rim 61 of wheel 57 connects power directly to the clock motor and causes the clock motor to run continuously to drive the slotted wheel until the microswitch arm drops into another slot 63, shutting off the clock motor and again energizes relay $K_2$ to start the pump motor and the pump. The cycle then begins again.

In FIG. 5 the slots on wheel 57 are shown a quadrant apart. Thus, if the time required for one revolution of the wheel at constant operation is 24 hours, the down-time of the pump while the wheel is moving between slots is six hours. After the clock is rotated to the next slot the microswitch arm will drop again actuating relay $K_2$ to turn off the clock motor and energize the pump. The down-time and the number of poundings required to stop the pump are adjustable by changing the wheel configuration.

And, of course, the circuit 54 can be set at the well, during pounding, at a level high enough so that some pounding is allowed before cut-off occurs. E.g. if the width of the slot 60, 62 is $3\frac{3}{4}°$ and revolution rate is one revolution per day, 30 minutes will be required for the slotted wheel to turn the $3\frac{3}{4}°$ to shut down the pump. The pump will therefore be allowed to pound for 30 minutes before shut-down. Adjustment of the shut-down time is made by changing the number of slots on the slotted wheel. For example, a four-slotted wheel gives a six-hour shut-down, a two-slotted wheel gives a 12-hour shut-down, etc. This, of course, assumes that the slotted wheel cycle is one dayy and that the slot is $3\frac{3}{4}°$ in width.

The present invention thus provides for an adjustable period of operation of the pump while it is pounding. Operation for a time during this period is often necessary to insure maximum production from the well. The apparatus of the present invention is so arranged as to provide for adjustable limited operation of the pump while it is pounding. A further advantage of the present invention is its sensitivity. The signal sensed must be below a certain level to actuate the control system.

Although the invention has been described in terms of specific embodiments set forth in detail, it should be understood that such description is by way of illustration only and the invention is not necessarily limited thereto since alternatives will be readily apparent to those skilled in the art, but rather by the scope of the following claims.

What is claimed is:

1. Apparatus for controlling the operating of an oil well pump comprising transducer-meter means for sensing transient heat flux corresponding to abnormal change in oil flow within a flowline of a wellhead, said means being located completely exterior of the flowline and generating an electrical signal based on the thermopile principle proportional to said sensed transient heat flux, without use of an external power source therefor, and controller means in electrical contact with said transducer-meter means and selectively responsive to said well pump when said abnormal change in oil flow occurs.

2. The apparatus of claim 1 in which said controller means is responsive only when said signal deviates from a pre-set level by a predetermined amount, denoting abnormal pumping operations.

3. The apparatus of claim 2 in which said controller means includes timer and reset means for stopping said pump for a preselected time interval and then resetting said timer and restarting said well pump.

4. The apparatus of claim 3 in which said timer and reset means includes timing wheel means, switch means for controlling the operation of the well pump, said switch means having a switch arm in contact with said timing wheel means, actuating means on said timing wheel for changing the position of said switch arm to open or close said switch means at least once during each revolution of said timing wheel means, motor means for rotating said timing means and relay means for actuating said motor means.

5. The apparatus of claim 4 further characterized in that said actuating means is a slot in the peripheral wali of said timing wheel.

6. The apparatus of claim 2 further characterized in that said controller means includes detector means having adjustable set-point level.

7. A method of controlling a well pump comprising the steps of sensing abnormal change in oil flow within a flowline of a wellhead via transient variation in heat flux detected completely exterior of said flowline based on the thermopile principle and without use of an external power source, generating an electrical signal due to a deviation in said signal from a pre-set level, and stopping said pumping apparatus in response to said deviation.

* * * * *